US009994052B2

(12) United States Patent
Sanada et al.

(10) Patent No.: US 9,994,052 B2
(45) Date of Patent: Jun. 12, 2018

(54) PRINTING APPARATUS CONFIGURED TO HOLD BATTERY

(71) Applicant: Brother Kogyo Kabushiki Kaisha, Nagoya-shi, Aichi-ken (JP)

(72) Inventors: Hitoshi Sanada, Nagoya (JP); Keiji Seo, Nagoya (JP); Takehiko Inaba, Chita-gun (JP); Hidenori Jo, Nagoya (JP); Yuki Nagashima, Toyokawa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days. days.

(21) Appl. No.: 15/457,263

(22) Filed: Mar. 13, 2017

(65) Prior Publication Data

US 2017/0355208 A1 Dec. 14, 2017

(30) Foreign Application Priority Data

Jun. 9, 2016 (JP) ..... 2016-114965

(51) Int. Cl.
*B41J 29/02* (2006.01)
*B41J 23/32* (2006.01)

(52) U.S. Cl.
CPC ..... *B41J 29/02* (2013.01); *B41J 23/32* (2013.01)

(58) Field of Classification Search
CPC . B41J 29/00; B41J 29/02; B41J 29/023; B41J 29/026; B41J 29/13; B41J 23/32
See application file for complete search history.

(56) References Cited

U.S. PATENT DOCUMENTS 7,116,344 B2 * 10/2006 Shimoda ..... B41J 3/36 347/222
7,825,944 B2 * 11/2010 Kaiya ..... B41J 29/13 347/222
2002/0024578 A1 * 2/2002 Yamashita ..... B41J 29/02 347/108
2004/0066447 A1 * 4/2004 Arnold ..... B65C 11/0284 347/109
2005/0162497 A1 * 7/2005 Matsui ..... B41J 3/36 347/109

FOREIGN PATENT DOCUMENTS

JP 2015-160423 A 9/2015

* cited by examiner

*Primary Examiner* — Kristal Feggins
(74) *Attorney, Agent, or Firm* — Banner & Witcoff, Ltd.

(57) ABSTRACT

A printing apparatus includes a printing part, an accommodating portion, a cover, a shaft portion, and an engaging portion. The cover is movable between a first position to close the accommodating portion and a second position to open the accommodating portion. The shaft portion extends in a first direction. The holding portion includes a first rotating member connected to the shaft portion and configured to rotate between a third position and a fourth position about the shaft portion. The first rotating member has a first part including a restricting portion configured to restrict the rotation of the first rotating member. The first rotating member has a second part having a thickness in the first direction greater than that of the first part.

16 Claims, 7 Drawing Sheets

PRINTING APPARATUS CONFIGURED TO HOLD BATTERY

CROSS REFERENCE TO RELATED APPLICATION

This application claims priority from Japanese Patent Application No. 2016-114965 filed Jun. 9, 2016. The entire content of the priority application is incorporated herein by reference.

TECHNICAL FIELD

The present disclosure relates to a printing apparatus capable of using a battery as a power source.

BACKGROUND

Conventionally, there is known a printing apparatus that can use a battery as a power source. In a printing apparatus known in the art, power is supplied to the entire printing apparatus by a battery housed in a housing part. The printing apparatus has a main body fixing part that holds the battery housed in the housing part. The main body fastening part has a main body protruding part and a main body urging part. One end portion of the main body protruding part is swingably supported at the outside of the housing part, and the other end portion thereof is swingable between a position protruding inward the housing part and a position disposed outside the housing part. The main body urging part biases the main body protruding part such that the main body protruding part protrudes inward the housing part. The battery is held by the other end portion of the main body protruding part protruding inward the housing part so as not to come off from the housing part. When the other end portion is disposed outside the housing part, the battery can be freely detached and attached from/to the housing part.

SUMMARY

In the above printing apparatus, a large force may be applied to the other end portion of the main body protruding part by an impact against the printing apparatus. In this case, the other end portion of the main body protruding part may swing from the inside of the housing part toward outside thereof by the large force applied thereto. When the other end portion of the main body protruding part is disposed outside the housing part, the battery is put into a detachable state. That is, in this state, the battery may come off from the housing part by an impact against the printing apparatus without a user's intention.

The object of the disclosure is to provide a printing apparatus capable of preventing a battery from coming off from a battery housing part due to an impact against the printing apparatus.

According to one aspect, the disclosure provides a printing apparatus including a printing part, an accommodating portion, a cover, a shaft portion, an engaging portion, and a holding portion including first and second rotating members. The printing part is configured to perform printing. The accommodating portion has a recessed part configured to accommodate a battery configured to supply power to the printing part. The cover is movable between a first position to close the accommodating portion and a second position to open the accommodating portion, and the cover has a specific surface configured to face the accommodating portion and an edge portion which is a contour of the cover. The shaft portion extends in a first direction perpendicular to the specific surface. The holding portion is configured to hold the cover at the first position. The engaging portion is configured to engage with the holding portion. The first rotating member has an engaged part. The first rotating member is connected to the shaft portion and configured to rotate between a third position and a fourth position about the shaft portion. The engaged part protrudes outside the edge portion so that the engaged part engages with the engaging portion when the first rotating member is positioned at the third position. The first rotating member in its entirety is positioned inside the edge portion so that the first rotating member is separated from the engaging portion when the first rotating member is positioned at the fourth position. The first rotating member includes a first part and a second part. The first part includes a restricting portion configured to restrict the rotation of the first rotating member from the third position to the fourth position. The shaft portion and the restricting portion define an imaginary plane passing through the shaft portion and the restricting portion. The imaginary plane defines a first specific direction and a second specific direction each perpendicular to the imaginary plane. The first specific direction is opposite to the second specific direction. The second part is positioned downstream of the first part in the second specific direction. The second part has a thickness in the first direction greater than that of the first part. The second rotating member is connected to the shaft portion and positioned downstream of the shaft portion in the first specific direction, the second rotating member being configured to rotate about the shaft portion together with the first rotating member.

According to another aspect, the disclosure provides a printing apparatus including a printing part, an accommodating portion, a cover, a shaft portion, an engaging portion, and a holding portion including first and second rotating members. The printing part is configured to perform printing. The accommodating portion has a recessed part configured to accommodate a battery configured to supply power to the printing part. The cover is movable between a first position to close the accommodating portion and a second position to open the accommodating portion, and the cover has a specific surface configured to face the accommodating portion and an edge portion which is a contour of the cover. The shaft portion extends in a first direction perpendicular to the specific surface. The holding portion is configured to hold the cover at the first position. The engaging portion is configured to engage with the holding portion. The first rotating member has an engaged part. The first rotating member is connected to the shaft portion and configured to rotate between a third position and a fourth position about the shaft portion. The engaged part protrudes outside the edge portion so that the engaged part engages with the engaging portion when the first rotating member is positioned at the third position. The first rotating member in its entirety is positioned inside the edge portion so that the first rotating member is separated from the engaging portion when the first rotating member is positioned at the fourth position. The first rotating member includes a first part and a second part. The first part includes a restricting portion configured to restrict the rotation of the first rotating member from the third position to the fourth position. The shaft portion and the restricting portion define an imaginary plane passing through the shaft portion and the restricting portion. The imaginary plane defines a first specific direction and a second specific direction each perpendicular to the imaginary plane. The first specific direction is opposite to the second specific direction. The imaginary plane imaginary divides the holding part into a first holding part and a second holding part. The first holding part provides a moment acting thereon that is balanced with that of the second holding part The second part is positioned downstream of the first part in the second specific direction. The second rotating member is connected to the shaft portion and positioned downstream of the shaft portion in the first specific direction, the second rotating member being configured to rotate about the shaft portion together with the first rotating member.

According to another aspect, the disclosure provides a printing apparatus including a printing part, an accommodating portion, a cover, a shaft portion, an engaging portion, and a holding portion including a first rotating member. The printing part is configured to perform printing. The accommodating portion has a recessed part configured to accommodate a battery configured to supply power to the printing part. The cover is movable between a first position to close the accommodating portion and a second position to open the accommodating portion, and the cover has a specific surface configured to face the accommodating portion and an edge portion which is a contour of the cover. The shaft portion extends in a first direction perpendicular to the specific surface. The holding portion is configured to hold the cover at the first position. The holding portion in its entirety has a gravity center thereof. The shaft portion passes through the gravity center. The engaging portion is configured to engage with the holding portion. The first rotating member has an engaged part. The first rotating member is connected to the shaft portion and configured to rotate between a third position and a fourth position about the shaft portion. The engaged part protrudes outside the edge portion so that the engaged part engages with the engaging portion when the first rotating member is positioned at the third position. The first rotating member in its entirety is positioned inside the edge portion so that the first rotating member is separated from the engaging portion when the first rotating member is positioned at the fourth position.

BRIEF DESCRIPTION OF THE DRAWINGS

The particular features and advantages of the disclosure will become apparent from the following description taken in connection with the accompanying drawings, in which.

DETAILED DESCRIPTION

Figure 1:
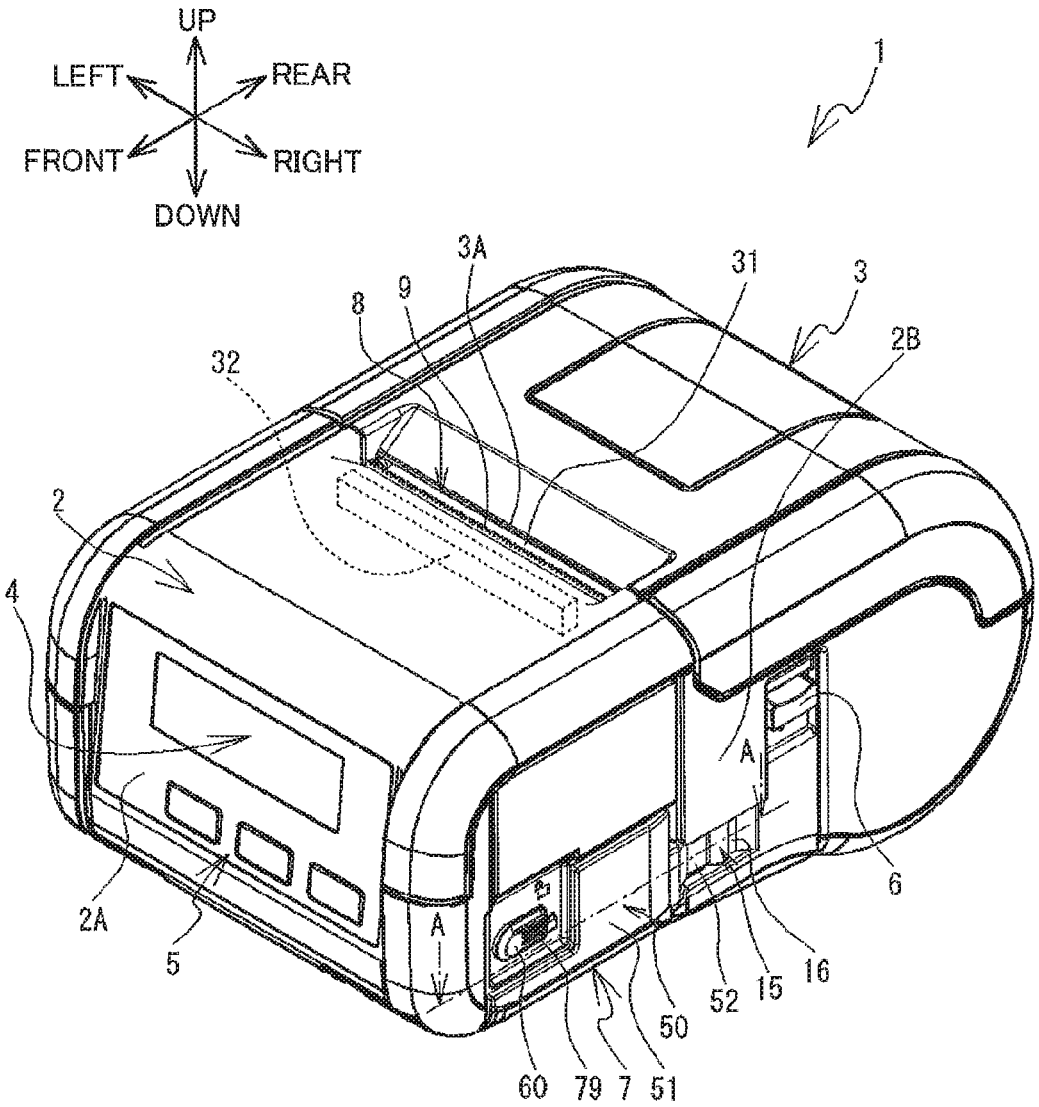
FIG. 1 is a perspective view of a printing apparatus viewed from a front-right and upper side according to an embodiment.

With reference to the drawings, an embodiment will be described. Hereinafter, the upper side, the lower side, the lower-right side, the upper-left side, the lower-left side, and the upper-right side of FIG. 1 are defined as the upper side, the lower side, the right side, the left side, the front side, and the rear side of a printer 1, respectively. A printer 1 can be connected to an external device (not illustrated) through a USB (registered trade name) cable (not illustrated). The printer 1 can print characters such as text and figures onto a print medium based on print data received from the external device. The print medium is, e.g., a 2-inch heat-sensitive label. The external terminal is, e.g., a general-purpose personal computer (PC).

With reference to FIG. 1, a configuration of the printer 1 will be described. The printer 1 has a main body casing 2 and a casing cover 3. The main body casing 2 has a substantially rectangular parallelepiped shape elongated in the front-rear direction. The casing cover 3 is a plate-like member disposed above the main body casing 2 at the rear side of a substantially center portion of the main body casing 2 in the front-rear direction. The rear end portion of the casing cover 3 is turnably supported at the upper side of the rear end portion of the main body casing 2. The casing cover 3 can be opened and closed with respect to the main body casing 2. Hereinafter, descriptions will be given assuming that the casing cover 3 is closed with respect to the main body casing 2 (see FIG. 1).

The main body casing 2 has a display 4, a plurality of switches, a lock lever 6, and a battery holding mechanism 7. The display 4 is provided at the upper portion of a front surface 2A of the main body casing 2. The display 4 displays characters printed on the heat-sensitive label. The plurality of switches 5 are provided below the display 4 on the front surface 2A. The plurality of switches 5 are provided for inputting various operational instructions to the printer 1 in response to a user's operation.

The lock lever 6 is provided at substantially the center portion in the front-rear direction of a right surface 2B of the main body casing 2. The lock lever 6 locks the front end portion of the casing cover 3 closed with respect to the main body casing 2 to thereby restrict the opening of the casing cover 3. The battery holding mechanism 7 is provided at the lower-front portion of the right surface 2B. A battery 10 (see FIG. 3) for supplying power to the entire printer 1 is housed in the battery holding mechanism 7 and is held therein in this state. Details of the battery holding mechanism 7 will be described later.

Inside the main body casing 2, a roll housing part (not illustrated) is formed below the casing cover 3. The roll housing part is a space where a roll (not illustrated) around which a heat-sensitive label is wound is housed. When the casing cover 3 is closed with respect to the main body casing 2, the casing cover 3 covers the roll housing part from above. When the casing cover 3 is opened with respect to the main body casing 2, the roll housing part is opened (exposed) upward. The user sets the roll in the roll housing part in a state where the casing cover 3 is opened with respect to the main body casing 2.

A platen roller 31 extending in the left-right direction is rotatably supported below a front end part 3A of the casing cover 3. The platen roller 31 conveys the heat-sensitive label while rotating. Inside the main body casing 2, a printing part 32 is provided so as to be opposite to the platen roller 31. In FIG. 1, the printing part 32 is denoted by the dashed line. The printing part 32 extends in parallel with the platen roller 31. The printing part 32 is a line thermal head that prints characters onto the heat-sensitive label. A discharge port 8 is formed between the front end part 3A and the rear end portion of the upper surface of the main body casing 2. The discharge port 8 is formed into a slit shape extending in the left-right direction. The heat-sensitive label printed by the printing part 32 passes through the discharge port 8 and is discharged outside the printer 1. Inside the discharge port 8, a cutter 9 extending in the left-right direction is provided. The cutter 9 cuts the heat-sensitive label discharged through the discharge port 8.

Although not illustrated, a control section and a drive section are provided inside the main body casing 2. The control section has a CPU that controls the printer 1 and a ROM that stores various data. The drive section is a motor for rotating the platen roller 31.

Figure 2:
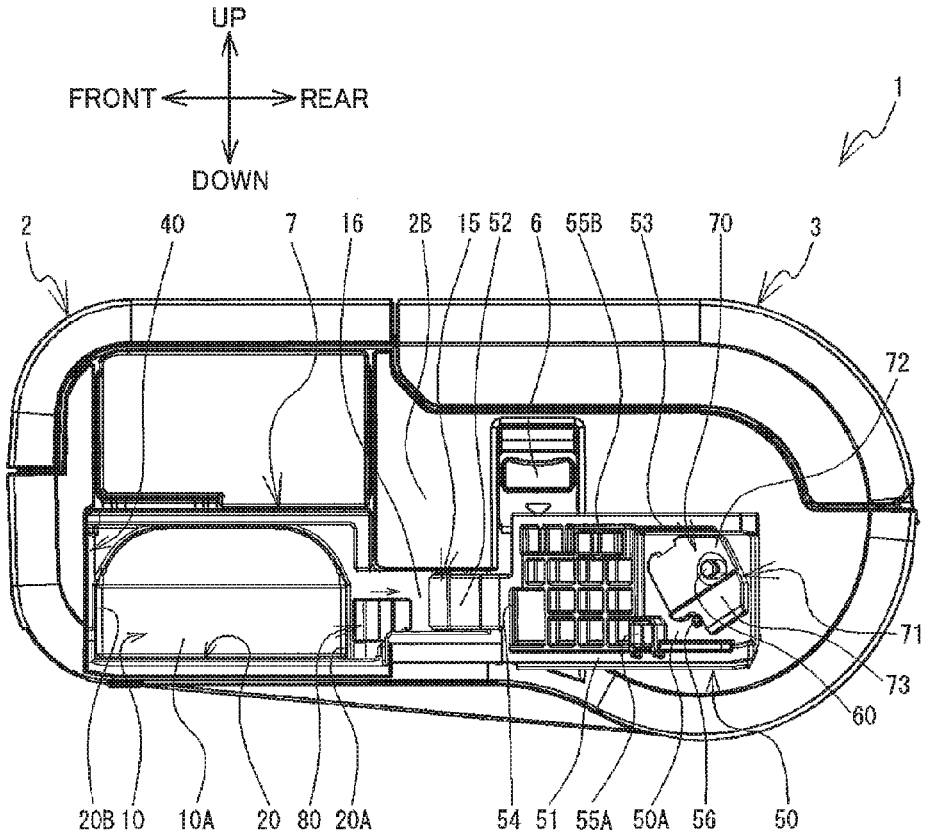
FIG. 2 is a right side view of the printing apparatus in a state where a battery cover is at an opening position and an inner lock member is at a battery unlock position, according to the embodiment.

With reference to FIGS. 2 to 8, a configuration of the battery holding mechanism 7 will be described. As illustrated in FIG. 2, the battery holding mechanism 7 includes a battery housing part 20, an engagement recessed part 40, a battery cover 50, a shaft part 60, a holding portion 70, and an inner lock member 80.

Figure 3:
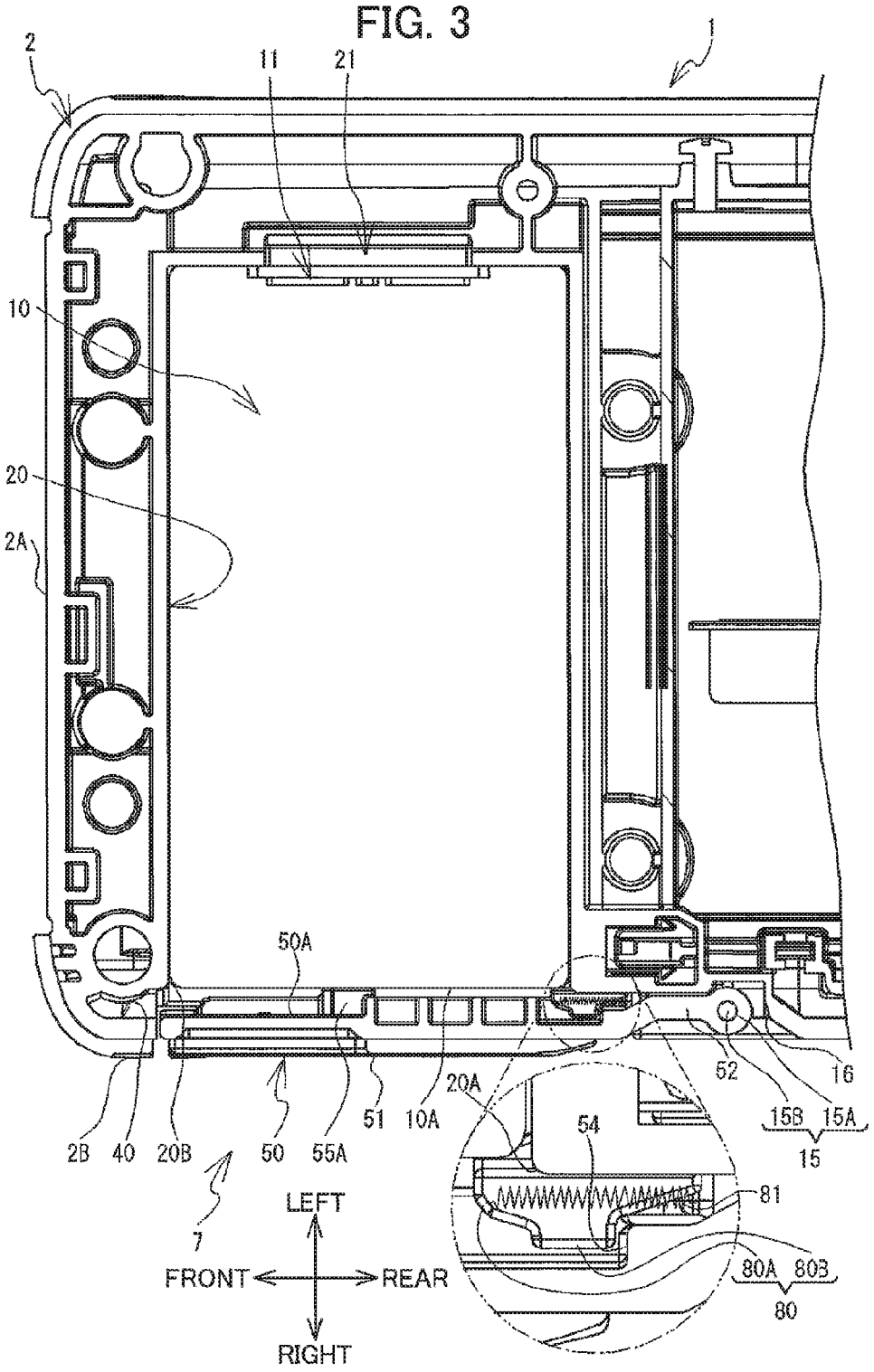
FIG. 3 is a cross-sectional view of the printing apparatus along A-A line of FIG. 1, according to the embodiment.

As illustrated in FIG. 3, the battery housing part 20 is recessed leftward from the right surface 2B. The battery housing part 20 is formed into a shape corresponding to the shape of the battery 10. The battery 10 of the present embodiment has a substantially rectangular parallelepiped shape with a rounded upper portion (see FIGS. 2 and 3). The battery 10 may be a primary battery or a secondary battery. The battery 10 is detachably housed in the battery housing part 20 from the right side. In the present embodiment, a right surface 10A of the battery 10 housed in the battery housing part 20 is substantially flush with an opening surface of the battery housing part 20.

A connection terminal 21 having a pair of positive and negative electrodes is provided at the bottom surface of the battery housing part 20. The connection terminal 21 is electrically connected to the control section. A battery terminal 11 is provided at the left surface of the battery 10 so as to correspond in position to the connection terminal 21. In a state where the battery 10 is housed in the battery housing part 20, the battery terminal 11 is electrically connected to the connection terminal 21. As a result, the battery 10 can supply power to the entire printer 1 including the printing part 32, the control section, and the drive section.

The engagement recessed part 40 is provided near the outside (front side) of a front edge 20B of the opening edge of the battery housing part 20. The engagement recessed part 40 is recessed frontward. A holding portion 70 (see FIG. 2) to be described later can be engaged with the engagement recessed part 40.

The battery cover 50 is supported by a hinge 15 so as to be turnable or pivotable between a closing position (see FIGS. 1 and 3) and an opening position (see FIG. 2). At the closing position, the battery cover 50 is closed with respect to the battery housing part 20 to cover the entire battery housing part 20 from the right side. The battery 10 is held in this state in the battery housing part 20. When the battery cover 50 is at the closing position, the left surface (specific surface 50A) of the battery cover 50 faces the opening surface of the battery housing part 20 in the left-right direction. At the opening position, the battery cover 50 is opened with respect to the battery housing part 20, with the result that the battery housing part 20 is opened (exposed). Hereinafter, descriptions will be given assuming that the battery cover 50 is at the closing position (see FIGS. 1 and 3) as a reference position.

Figure 4:
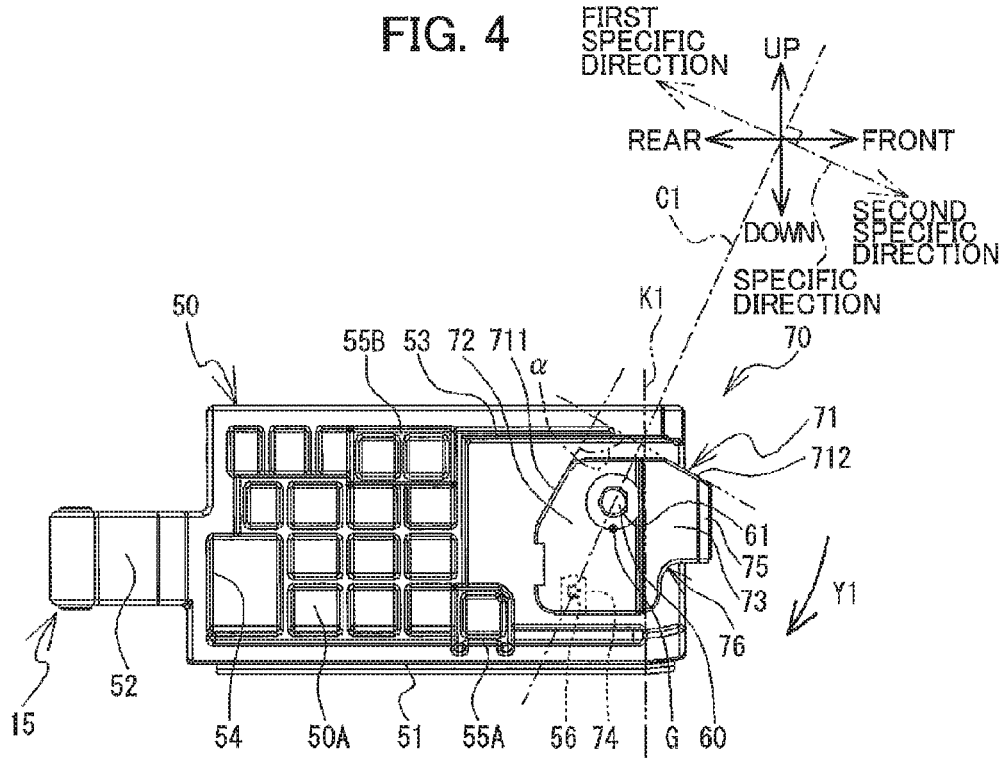
FIG. 4 is a left side view of the battery cover and a holding portion when a first rotating member is positioned at a battery lock position, according to the embodiment.

As illustrated in FIGS. 3 and 4, the battery cover 50 is a plate-like member disposed to the right of the battery housing part 20. The battery cover 50 has a cover part 51 and an extending part 52. The cover part 51 has a substantially rectangular shape having a size larger than that of the battery housing part 20 in a side view. The extending part 52 extends rearward from substantially the center of the rear end portion of the cover part 51. The extending part 52 has a hinge hole 15A constituting the hinge 15. The hinge hole 15A penetrates the rear end portion of the extending part 52 in the up-down direction. A hinge shaft 15B rotatably penetrates the hinge hole 15A in the up-down direction. The hinge shaft 15B is provided in a recessed part 16 of the right surface 2B that is recessed leftward from the lower-front side of the lock lever 6 (see FIG. 1). Thus, the hinge 15 is constituted of the hinge hole 15A and the hinge shaft 15B.

As illustrated in FIG. 4, the battery cover 50 is provided with a rotation restricting rib 53, a contacting rib 54, a plurality of protruding ribs 55A, 55B, and a projection 56. The rotation restricting rib 53 protrudes leftward from the upper portion of the specific surface 50A and extends in the front-rear direction. The contacting rib 54 is provided at a portion on the specific surface 50A near a connection portion between the cover part 51 and the extending part 52. The contacting rib 54 protrudes leftward from the specific surface 50A.

The protruding rib 55A is provided at the lower portion of the cover part 51 and slightly frontward of the center of the cover part 51 in the front-rear direction. The protruding rib 55B is provided at the upper portion of the cover part 51 and the rearward of the protruding rib 55A. The protruding ribs 55A and 55B each protrude leftward from the specific surface 50A in a rectangular shape.

The specific surface 50A is provided with a plurality of other ribs, in addition to the rotation restricting rib 53, the contacting rib 54, and the plurality of protruding ribs 55A, 55B. The plurality of ribs including the rotation restricting rib 53, the contacting rib 54, and plurality of protruding ribs 55A, 55B reinforce the strength of the battery cover 50. The left end portions of the respective protruding ribs 55A and 55B are disposed leftmost among the left end portions of the plurality of ribs. When the battery cover 50 is at the closing position, the left end portions of the respective protruding ribs 55A and 55B contact the right surface 10A of the battery 10 housed in the battery housing part 20 from the right side (see FIG. 3).

The projection 56 is provided at the lower-front portion of the cover part 51. The projection 56 projects leftward from the specific surface 50A in a columnar shape.

Figure 8:
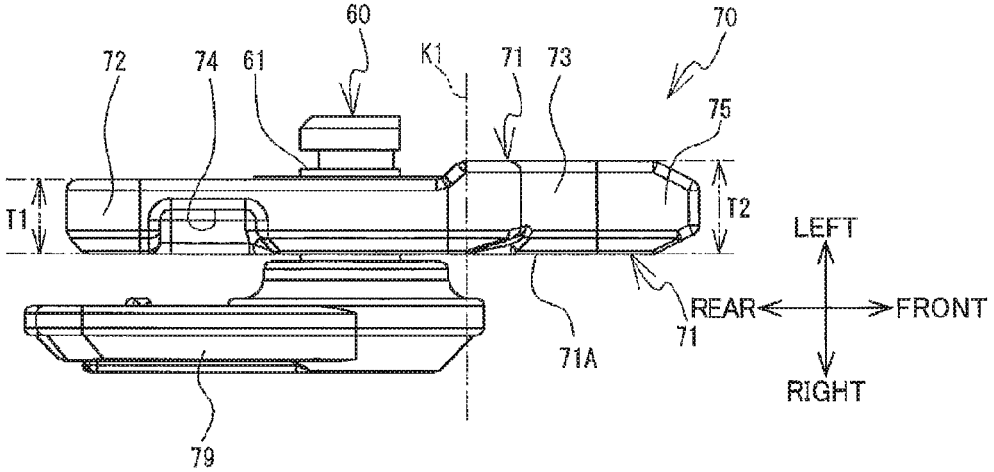
FIG. 8 illustrates the holding portion viewed from a lower side, according to the embodiment.

The shaft part 60 extends in the direction (left-right direction) perpendicular to the extending direction of the specific surface 50A (see FIG. 8). The extending direction of the shaft part 60 is also perpendicular to the extending direction of the hinge shaft 15B. The shaft part 60 penetrates a part of the battery cover 50 that is positioned at the upper-front of the projection 56 in the left-right direction. As a result, the shaft part 60 is rotatably by the battery cover 50.

As illustrated in FIGS. 4 to 7, the holding portion 70 is provided on the battery cover 50. The holding portion 70 can hold the battery cover 50 at the closing position (see FIGS. 1 and 3). The holding portion 70 has a first rotating member 71 and a second rotating member 79. The first rotating member 71 is disposed on the left side (paper surface front side in each of FIGS. 4 and 6) of the battery cover 50. The first rotating member 71 can be rotated about the shaft part 60 between a cover lock position (see FIGS. 4 and 5) and a cover unlock position (see FIGS. 6 and 7). The first rotating member 71 is rotated in the clockwise direction (hereinafter, referred to as "arrow Y1 direction", see FIGS. 4 and 5) in a left side view to be moved from the cover lock position to the cover unlock position. On the other hand, when the first rotating member 71 is rotated in the counterclockwise direction (hereinafter, referred to as "arrow Y2 direction", see FIGS. 6 and 7) in a left side view, it is moved from the cover unlock position to the cover lock position.

Figure 5:
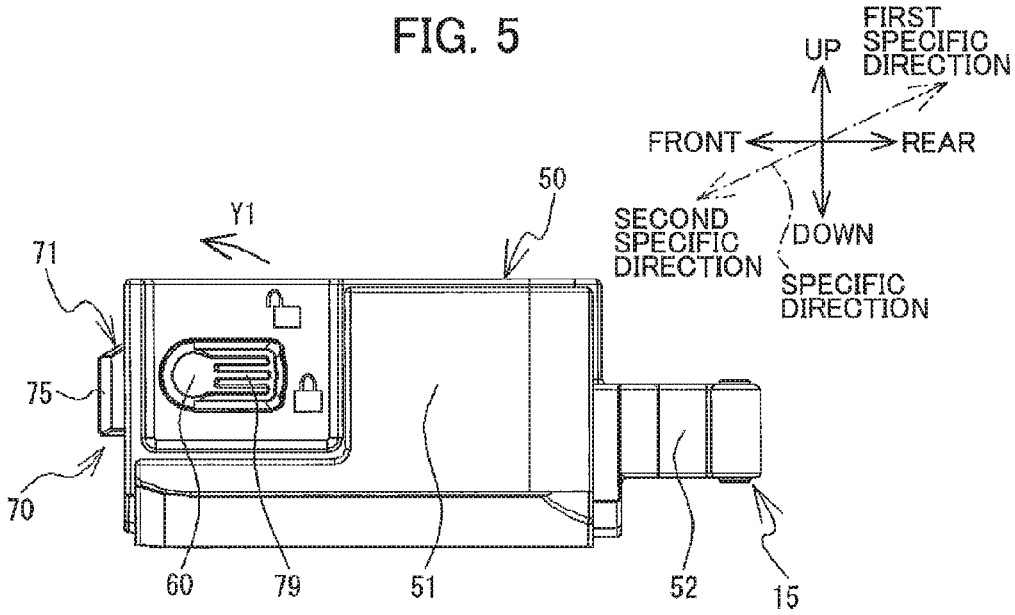
FIG. 5 is a right side view of the battery cover and the holding portion when the first rotating member is positioned at the battery lock position, according to the embodiment.

As illustrated in FIGS. 4 and 5, at the cover lock position, a part (hereinafter, referred to as "engagement protruding part 75", as an example of engaged part) of the first rotating member 71 protrudes to the outside (front side) of the edge (in the present embodiment, front edge of the battery cover 50) of the battery cover 50. In this case, the engagement protruding part 75 is engaged with the engagement recessed part 40 (see FIG. 3). Thus, when the first rotating member 71 is at the cover lock position, the battery cover 50 is restricted from being turned from the closing position (see FIGS. 1 and 3) to the opening position (see FIG. 2). In this manner, the holding portion 70 holds the battery cover 50 at the closing position.

Figure 6:
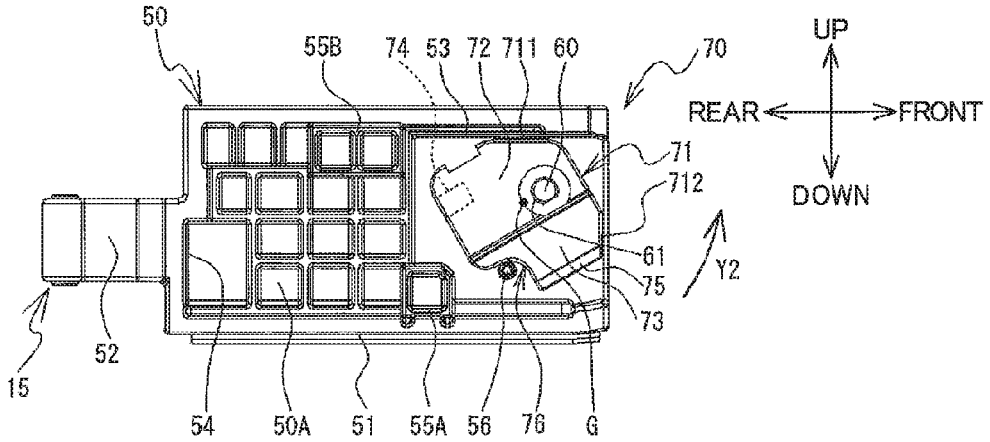
FIG. 6 is the left side view of the battery cover and the holding portion when the first rotating member is positioned at a battery unlock position, according to the embodiment.
Figure 7:
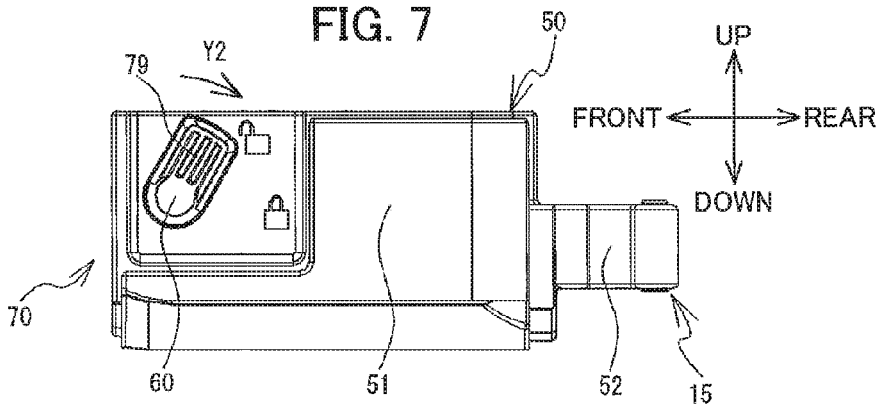
FIG. 7 is the right side view of the battery cover and the holding portion when the first rotating member is positioned at the battery unlock position, according to the embodiment.

As illustrated in FIGS. 6 and 7, at the cover unlock position, the entire first rotating member 71 is disposed within the edges of the battery cover 50. In this case, the engagement protruding part 75 is separated from the engagement recessed part 40 (see FIG. 3). Thus, when the first rotating member 71 is at the cover unlock position, the battery cover 50 can freely be turned or pivoted between the closing position (see FIGS. 1 and 3) and the opening position (see FIG. 2). Hereinafter, descriptions will be given assuming that the first rotating member 71 is at the cover lock position (see FIGS. 4 and 5).

As illustrated in FIG. 4, the first rotating member 71 is connected to a part of the shaft part 60 on the specific surface 50A side of the battery cover 50. More specifically, the first rotating member 71 is connected to substantially the center portion of the shaft part 60. The shaft part 60 penetrates the first rotating member 71 above a gravity center G of the entire holding portion 70 (first and second rotating members 71 and 79). The gravity center G of the entire holding portion 70 in the present embodiment is disposed at the center of the first rotating member 71 in a side view. The shaft part 60 is fixed to the first rotating member 71 by a C-ring 61.

The first rotating member 71 is a plate-like member having a polygonal shape in a side view. The first rotating member 71 includes a side 711, a side 712, and a cut part 76. The side 711 defines the upper-rear side edge of the first rotating member 71 and extends obliquely upward with respect to the front side. The side 712 defines the upper-front side edge of the first rotating member 71 and extends obliquely downward with respect to the front side. An angle $\alpha$ formed by the sides 711 and 712 is substantially 90°. When the first rotating member 71 is at the cover unlock position, the side 711 of the first rotating member 71 contacts the rotation restricting rib 53 (see FIG. 6). In the printer 1, by setting the angle $\alpha$ to substantially 90°, the side 712 can be disposed within the front edge of the battery cover 50 while ensuring the size (i.e., strength) of the engagement protruding part 75.

The cut part 76 is provided at the lower-right portion of the first rotating member 71. The cut part 76 has a substantially rectangular shape. When the first rotating member 71 is at the cover unlock position, the projection 56 is disposed in a space formed by the cut part 76 (see FIG. 6). In this state, the first rotating member 71 is restricted from being moved from the cover unlock position.

The first rotating member 71 has a first part 72 and a second part 73. A virtual plane K1 perpendicular to the front-rear direction is defined frontward of the gravity center G of the entire holding portion 70. The first part 72 is disposed rearward of the virtual plane K1. The first part 72 includes a portion where the shaft part 60 penetrates the first rotating member 71. The C-ring 61 is provided leftward of the first part 72.

The first part 72 has a restricting portion 74. The restricting portion 74 is provided at the lower-rear portion of the first part 72. Here, a virtual plane C1 passing the center line of the shaft part 60 and the restricting portion 74 is defined. The direction perpendicular to the virtual plane C1 is referred to as "specific direction". Of the directions indicated by the specific direction (double-headed long dashed short dashed line arrow), the direction extending substantially rearward is referred to as "first specific direction", and the direction opposite to the first specific direction is referred to as "second specific direction". In the present embodiment, the restricting portion 74 is provided on the opposite side to the shaft part 60 with respect to the gravity center G of the entire holding portion 70 in the direction perpendicular to the specific direction. That is, the distance between the shaft part 60 and the restricting portion 74 is larger than the distance between the shaft part 60 and the gravity center G of the entire holding portion 70. The restricting portion 74 has a shape slightly larger than the projection 56 in a side view and recessed leftward from a right surface 71A (see FIG. 8) of the first rotating member 71. When the first rotating member 71 is at the cover lock position, the projection 56 is fitted in the restricting portion 74. As a result, the first rotating member 71 is restricted from being rotated from the cover lock position, whereby a state where the holding portion 70 holds the battery cover 50 at the closing position is maintained.

The second part 73 is disposed on the second specific direction side relative to the first part 72. That is, the second part 73 is disposed frontward of the virtual plane K1. The second part 73 includes the engagement protruding part 75 and the cut part 76. When the first rotating member 71 is at the cover lock position, a part (engagement protruding part 75) of the second part 73 protrudes frontward of the front edge of the battery cover 50 to be engaged with the engagement recessed part 40.

As illustrated in FIG. 8, a thickness T1 of the first part 72 in the left-right direction is smaller than a thickness T2 of the second part 73 in the left-right direction. The engagement protruding part 75 is engaged with the engagement recessed part 40, so that the strength thereof needs to be secured. The engagement protruding part 75 is included in the second part 73 having the thickness T2 larger than the thickness T1. The C-ring 61 is included in the first part 72 having the thickness T1 smaller than the thickness T2. Thus, in the printer 1, as compared to a case where the C-ring 61 is included in the second part 73, the thickness of the entire holding portion 70 in the left-right direction can be reduced. That is, in the printer 1, the thickness of the entire holding portion 70 in the left-right direction can be reduced while securing the strength of the first rotating member 71.

As illustrated in FIG. 5, the second rotating member 79 is disposed on the right side (paper surface front side in each of FIGS. 5 and 7) of the battery cover 50. The second rotating member 79 is connected to a part of the shaft part 60 on the side opposite to the specific surface 50A side of the battery cover 50. More specifically, in the present embodiment, the second rotating member 79 is connected to the right end portion of the shaft part 60. In the present embodiment, the second rotating member 79 and the shaft part 60 are integrally formed as a single member. The second rotating member 79 is a plate-like member disposed in the first specific direction with respect to the shaft part 60. The second rotating member 79 can be rotated together with the first rotating member 71 about the shaft part 60.

When the first rotating member 71 is at the cover lock position, the second rotating member 79 extends rearward from the shaft part 60 (see FIG. 5). When the first rotating member 71 is at the cover unlock position, the second rotating member 79 extends obliquely upward with respect to the rear side from the shaft part 60 (see FIG. 7).

In the holding portion 70 having the above configuration, the first part 72 and the second rotating member 79 exist on the first specific direction side with respect to the virtual plane C1; on the other hand, the second part 73 exists on the second specific direction side with respect to the virtual plane C1. In the holding portion 70, by making the thickness T1 of the first part 72 smaller than the thickness T2 of the second part 73, the weight balance of the holding portion 70 in the specific direction is maintained. In this manner, the moment acting on the portion on the first specific direction side with respect to the virtual plane C1 and the moment acting on the portion on the second specific direction side with respect to the virtual plane C1 are substantially balanced.

As illustrated in FIGS. 2 and 3, the inner lock member 80 is provided on the right surface 2B of the main body casing 2 and near a rear edge 20A of the opening edge of the battery housing part 20. The inner lock member 80 is provided inside (on the left side of) the battery cover 50 so as to prevent the battery 10 from coming off from the battery housing part 20. The inner lock member 80 can be moved in the front-rear direction between a battery lock position (see FIG. 3) and a battery unlock position (see FIG. 2).

As illustrated in FIG. 3, at the battery lock position, the front portion of the inner lock member 80 protrudes inward (frontward) of the rear edge 20A of the battery housing part 20. That is, at the battery lock position, the front end portion of the inner lock member 80 is positioned frontward of the rear edge 20A, and the rear end portion of the inner lock member 80 is positioned rearward of the rear edge 20A. Thus, at the battery lock position, a part of the left surface of the inner lock member 80 that is positioned frontward of the rear edge 20A contacts the right surface 10A of the battery 10 housed in the battery housing part 20. As a result, the inner lock member 80 prevents the battery 10 from coming off from the battery housing part 20.

As illustrated in FIG. 2, at the battery unlock position, the entire inner lock member 80 is positioned outside the opening edge of the battery housing part 20. That is, at the battery unlock position, the front end portion of the inner lock member 80 is positioned rearward of the rear edge 20A. Specifically, at the battery unlock position, the inner lock member 80 is positioned between the rear edge 20A and the hinge 15 in the front-rear direction. Thus, at the battery unlock position, the inner lock member 80 is separated rearward from the battery 10 housed in the battery housing part 20. In this state, the battery 10 can be freely detached/attached from/to the battery housing part 20.

As illustrated in FIG. 3, the inner lock member 80 has a main body part 80A and a protruding part 80B. The main body part 80A has a substantially rectangular parallelepiped shape. A space is formed inside the main body part 80A. The protruding part 80B is positioned at substantially the center of the main body part 80A in the front-rear direction so as to protrude rightward from the right surface of the main body part 80A. When the inner lock member 80 and the battery cover 50 are at the battery lock position and at the closing position, respectively, the rear end portion of the protruding part 80B is positioned frontward of the contacting rib 54. In this case, the contacting rib 54 can contact the protruding part 80B from the rear side. Thus, when the contacting rib 54 contacts the protruding part 80B from the rear side, rearward movement of the inner lock member 80 from the battery lock position to the battery unlock position is restricted.

When the inner lock member 80 is at the battery unlock position, the protruding part 80B is positioned on the moving track of the contacting rib 54 when the battery cover 50 is turned from the opening position to the closing position. In this case, when the battery cover 50 is turned from the opening position to the closing position, the contacting rib 54 can contact the protruding part 80B from the right side. When the contacting rib 54 contacts the protruding part 80B from the right side, the battery cover 50 is restricted from being turned from the opening position to the closing position.

A urging member 81 is provided in the space formed inside the main body part 80A. The urging member 81 of the present embodiment is a compression coil spring. One end of the urging member 81 is fixed to the inner lock member 80. The other end of the urging member 81 is fixed to a fixing part provided on the right surface 2B and at the rear side of the inner lock member 80. With this configuration, the urging member 81 biases the inner lock member 80 frontward (the direction from the battery unlock position (see FIG. 2) toward the battery lock position (see FIG. 3)).

With reference to FIGS. 2 to 8, a users procedure in which the battery 10 is housed and held in the battery holding mechanism 7 will be described. Hereinafter, descriptions will be given assuming that the battery cover 50, the first rotating member 71, and the inner lock member 80 are at the closing position, the cover lock position, and the battery lock position, respectively (see FIGS. 1 and 3).

As illustrated in FIG. 5, the user rotates the second rotating member 79 in the arrow Y1 direction. With the rotation of the second rotating member 79, the first rotating member 71 is rotated in the arrow Y1 direction through the shaft part 60, as illustrated in FIG. 4. In this case, the first rotating member 71 is deflected leftward to cause the projection 56 to come off from the restricting portion 74. The first rotating member 71 runs on the projection 56 and continues being rotated. That is, the projection 56 is slid relative to the right surface 71A of the first rotating member 71 (second part 73). Since the thickness T1 is smaller than the thickness T2, the first part 72 is bent or deflected more easily than the second part 73. Thus, the user can rotate the second rotating member 79 with a small force. Further, the deflection of the first part 72 alleviates component tolerance ranges of the respective first part 72 (restricting portion 74) and the projection 56. Further, the distance between the shaft part 60 and the restricting portion 74 is larger than the distance between the shaft part 60 and the gravity center G of the entire holding portion 70. Thus, by the principle of leverage, the user can rotate the second rotating member 79 with a smaller force than in a case where the distance between the shaft part 60 and the restricting portion 74 is equal to or less than the distance between the shaft part 60 and the gravity center G of the entire holding portion 70.

As illustrated in FIG. 6, when the first rotating member 71 is rotated to the cover unlock position, the projection 56 is disposed in the space formed by the cut part 76, and the deflected first rotating member 71 is restored to its original shape. Thus, when the first rotating member 71 is rotated, the projection 56 interferes with the cut part 76, thereby restricting the rotation of the first rotating member 71. That is, when the projection 56 is disposed in the space formed by the cut part 76, the first rotating member 71 is held at the cover unlock position.

As illustrated in FIGS. 2 and 3, the engagement protruding part 75 engaged with the engagement recessed part 40 is separated from the engagement recessed part 40. As a result, the battery cover 50 can be turned from the closing position (see FIGS. 1 and 3) to the opening position (see FIG. 2). In this state, the user turns the battery cover 50 in the counterclockwise direction in a plan view.

The battery cover 50 is turned about the hinge 15 from the closing position to the opening position. The contacting rib 54 contacting the inner lock member 80 from the rear side is separated rightward from the inner lock member 80. As a result, the inner lock member 80 can be moved between the battery lock position (see FIG. 3) and the battery unlock position (see FIG. 2). In this state, the user moves the inner lock member 80 rearward against the urging force of the urging member 81.

The inner lock member 80 is moved rearward from the battery lock position to the battery unlock position. As a result, the battery 10 can be housed in the battery housing part 20. In this state, the user houses the battery 10 in the battery housing part 20 from the right side.

For example, there may be a case where the battery 10 is not housed properly in the battery housing part 20. An example of this includes a situation where the right surface 10A of the battery 10 is positioned outside (rightward) of the opening surface of the battery housing part 20. In such a case, when the inner lock member 80 is moved frontward from the battery unlock position by the urging force of the urging member 81, the front end portion of the inner lock member 80 interferes with the battery 10. This restricts the inner lock member 80 from being moved from the battery unlock position to the battery lock position. When the user turns the battery cover 50 in the clockwise direction in a plan view in this state, the contacting rib 54 interferes with the right surface of the protruding part 80B since the rear end portion of the protruding part 80B is positioned rearward of the contacting rib 54. This restricts the battery cover 50 from being turned from the opening position to the closing position. Thus, when the battery 10 is not housed properly in the battery housing part 20, the battery cover 50 cannot be turned up to the closing position, so that a user's wrong operation can be prevented.

When the battery 10 is housed properly in the battery housing part 20, the inner lock member 80 is moved frontward from the battery unlock position to the battery lock position by the urging force of the urging member 81. A part of the left surface of the inner lock member 80 that is positioned frontward of the rear edge 20A contacts the right surface 10A of the battery 10 housed in the battery housing part 20. The rear end portion of the protruding part 80B is positioned frontward of the contacting rib 54. As a result, the battery cover 50 can be turned to the closing position. In this state, the user turns the battery cover 50 in the clockwise direction in a plan view.

The battery cover 50 is turned about the hinge 15 from the opening position to the closing position. The plurality of protruding ribs 55A and 55B contact, from the right, the right surface 10A of the battery 10 housed in the battery housing part 20. This prevents the battery 10 from coming off from the battery housing part 20. As described above, in the printer 1, the coming off of the battery 10 from the battery housing part 20 is prevented by the two members, i.e., the inner lock member 80 and battery cover 50 (plurality of protruding ribs 55A and 55B). That is, a force acts evenly on the inner lock member 80 and the battery cover 50. Thus, coming off of the battery 10 from the battery housing part 20 is prevented more reliably than in a case where only a single member contacts the battery 10. Further, even if one of the inner lock member 80 and battery cover 50 fails to function properly, coming off of the battery 10 can be prevented by the other one.

Further, the inner lock member 80 contacts the rear portion of the battery 10 housed in the battery housing part 20. The protruding rib 55A contacts substantially the front-rear direction center portion of the battery 10 housed in the battery housing part 20. As described above, the inner lock member 80 and protruding rib 55A contact two separate portions of the battery 10. Thus, a force is more easily distributed onto the inner lock member 80 and battery cover 50.

As illustrated in FIG. 7, the user rotates the second rotating member 79 in the arrow Y2 direction in a state where the battery cover 50 is at the closing position. With the rotation of the second rotating member 79, the first rotating member 71 is rotated in the arrow Y2 direction through the shaft part 60, as illustrated in FIG. 6. In this case, the first rotating member 71 is deflected leftward, runs on the projection 56 positioned at the cut part 76, and continues being rotated.

As illustrated in FIG. 4, when the first rotating member 71 is rotated to the cover lock position, the projection 56 is fitted in the restricting portion 74, and the deflected first rotating member 71 is restored to its original shape. Thus, when the first rotating member 71 is rotated, the projection 56 interferes with the restricting portion 74, thereby restricting the rotation of the first rotating member 71. That is, when the projection 56 is fitted in the restricting portion 74, the first rotating member 71 is held at the cover lock position. When the first rotating member 71 is disposed at the cover lock position, the engagement protruding part 75 is engaged with the engagement recessed part 40. As a result, the battery cover 50 is held at the closing position (see FIGS. 1 and 3).

As described above, when the battery cover 50 is disposed at the closing position in a state where the battery 10 is housed in the battery housing part 20, the battery 10 is held at the battery housing part 20. When the first rotating member 71 is rotated to the cover lock position in this state, the engagement protruding part 75 protrudes outside the front edge of the battery cover 50 to be engaged with the engagement recessed part 40. As a result, the battery cover 50 is restricted from being moved from the closing position to the opening position. The restricting portion 74 restricts the rotation of the first rotating member 71 from the cover lock position to the cover unlock position. Thus, in the printer 1, a state where the holding portion 70 holds the battery cover 50 at the closing position can be maintained. For example, when an impact is applied to the printer 1 in the first specific direction, a force rotating in the arrow Y1 direction (rotation direction from the cover lock position to the cover unlock position) is applied to a part of the holding portion 70 on the opposite side to the shaft part 60 with respect to the gravity center G of the entire holding portion 70. However, in the printer 1, the first rotating member 71 is restricted from being rotated in the arrow Y1 direction from the cover lock position by the restricting portion 74, whereby the turning of the battery cover 50 from the closing position to the opening position is prevented. Thus, in the printer 1, when an impact is applied to the printer 1 in the first specific direction, coming off of the battery 10 from the battery housing part 20 can be prevented.

The second rotating member 79 extends in the first specific direction. The first part 72 is positioned closer to the first specific direction side than the second part 73. The thickness T1 of the first part 72 is smaller than the thickness T2 of the second part 73, so that, in the printer 1, the weight balance of the holding portion 70 in the specific direction is easily maintained. Thus, in the holding portion 70 of the printer 1, the moment acting on the portion on the first specific direction side with respect to the virtual plane C1 and the moment acting on the portion on the second specific direction side with respect to the virtual plane C1 are easily balanced. In the present embodiment, in the holding portion 70, moment acting on the portion on the first specific direction side and moment acting on the portion on the second specific direction side are substantially balanced. Thus, when, for example, an impact is applied to the printer 1 in a direction crossing the specific direction, the first rotating member 71 at the cover lock position is rotated to prevent the battery cover 50 from being turned from the closing position to the opening position. Therefore, in the printer 1, when an impact is applied to the printer 1 in a direction crossing the specific direction, the battery 10 can be prevented from coming off from the battery housing part 20. As described above, in the printer 1, the battery 10 can be prevented from coming off from the battery housing part 20 due to an impact applied to the printer 1. This in turn can prevent instantaneous power interruption due to disconnection between the connection terminal 21 and the battery terminal 11. For example, even if the user drops the printer 1, he or she can still use the printer 1 without problem unless the battery 10 comes off from the battery housing part 20 due to an impact to the printer 1.

An external force easily affects the engagement protruding part 75 to be engaged with the engagement recessed part 40. Thus, the engagement protruding part 75 needs to have predetermined strength. In the present embodiment, the engagement protruding part 75 is included in the second part 73 having the thickness T2 larger than the thickness T1. Thus, in the printer 1, the strength of the first rotating member 71 is secured more reliably than in a case where the engagement protruding part 75 is included in the first part 72 having the thickness T1.

The shaft part 60 is rotatably supported by the battery cover 50. The first rotating member 71 is connected to a part of the shaft part 60 on the specific surface 50A side of the battery cover 50. The second rotating member 79 is connected to a part of the shaft part 60 on the side opposite the specific surface 50A side of the battery cover 50. Thus, the user can easily rotate the second rotating member 79 by pinching it. This in turn allows the user to easily rotate the first rotating member 71 between the cover lock position and the cover unlock position.

When the first rotating member 71 is at the cover lock position, the projection 56 is fitted in the recessed restricting portion 74. This can restrict the first rotating member 71 from being rotated in both the arrow Y1 direction and the arrow Y2 direction from the cover lock position.

The inner lock member 80 can be moved between the battery lock position and the battery unlock position. The inner lock member 80 is biased or urged by the urging member 81 from the battery unlock position toward the battery lock position. At the battery lock position, a part of the left surface of the inner lock member 80 that is positioned frontward of the rear edge 20A contacts the right surface 10A of the battery 10 housed in the battery housing part 20. Thus, in the printer 1, even if the battery cover 50 is turned to the opening position due to an impact applied to the printer 1, coming off of the battery 10 from the battery housing part 20 can be prevented.

When the battery cover 50 is at the closing position, the contacting rib 54 contacts the protruding part 80B of the inner lock member 80 at the battery lock position from the rear side. Thus, when the battery cover 50 is at the closing position, the contacting rib 54 can restrict the movement of the inner lock member 80 from the battery lock position to the battery unlock position. Thus, in the printer 1, the battery 10 can be prevented from coming off from the battery housing part 20 due to an impact applied to the printer 1.

When the battery cover 50 is turned about the hinge 15 from the closing position to the opening position, the contacting rib 54 contacting the inner lock member 80 from the rear side is separated rightward from the inner lock member 80. As a result, the inner lock member 80 can be moved between the battery lock position and the battery unlock position. In the present embodiment, when the inner lock member 80 is at the battery unlock position, it is disposed between the battery housing part 20 and the hinge 15 in the front-rear direction. That is, the inner lock member 80 is disposed near the hinge 15. In this case, the contacting rib 54 is not separated from the inner lock member 80 unless the battery cover 50 is opened wider than in a case where the inner lock member 80 is disposed at a position separate from the hinge 15. Thus, in the printer 1, even if, for example, the battery cover 50 is opened with respect to the battery housing part 20 due to an impact applied to the printer 1, the inner lock member 80 can be prevented from being put into a movable state from the battery lock position to the battery unlock position. Thus, in the printer 1, the battery 10 can be prevented from coming off from the battery housing part 20 due to an impact applied to the printer 1.

The plurality of protruding ribs 55A and 55B protrude leftward from the specific surface 50A. When the battery cover 50 is at the closing position, the left end portions of the respective protruding ribs 55A and 55B contact the right surface 10A of the battery 10 housed in the battery housing part 20 from the right side. As a result, the plurality of protruding ribs 55A and 55B can prevent the battery 10 from coming off from the battery housing part 20.

In the present embodiment, the printing part 32 corresponds to "printing section". The battery 10 corresponds to "battery". The battery housing part 20 corresponds to "accommodating portion". The specific surface 50A corresponds to "specific surface". The closing position corresponds to "first position". The opening position corresponds to "second position". The battery cover 50 corresponds to "cover". The left-right direction of the printer 1 when the battery cover 50 is at the closing position corresponds to "first direction". The shaft part 60 corresponds to "shaft portion". The holding portion 70 corresponds to "holding portion". The engagement recessed part 40 corresponds to "engaging portion". The cover lock position corresponds to "third position". The cover unlock position corresponds to "fourth position". The first rotating member 71 corresponds to "first rotating member". The second rotating member 79 corresponds to "second rotating member". The restricting portion 74 corresponds to "restricting portion". The first part 72 corresponds to "first part". The second part 73 corresponds to "second part". The virtual plane C1 corresponds to "imaginary plane".

The projection 56 corresponds to "projection". The battery lock position corresponds to "fifth position". The battery unlock position corresponds to "sixth position". The inner lock member 80 corresponds to "moving member". The rearward direction of the printer 1 corresponds to "third direction". The urging member 81 corresponds to "urging member". The frontward direction of the printer 1 corresponds to "second direction". The contacting rib 54 corresponds to "contacting part". The hinge 15 corresponds to "hinge". The protruding ribs 55A and 55B correspond to "protruding portion".

Figure 9:
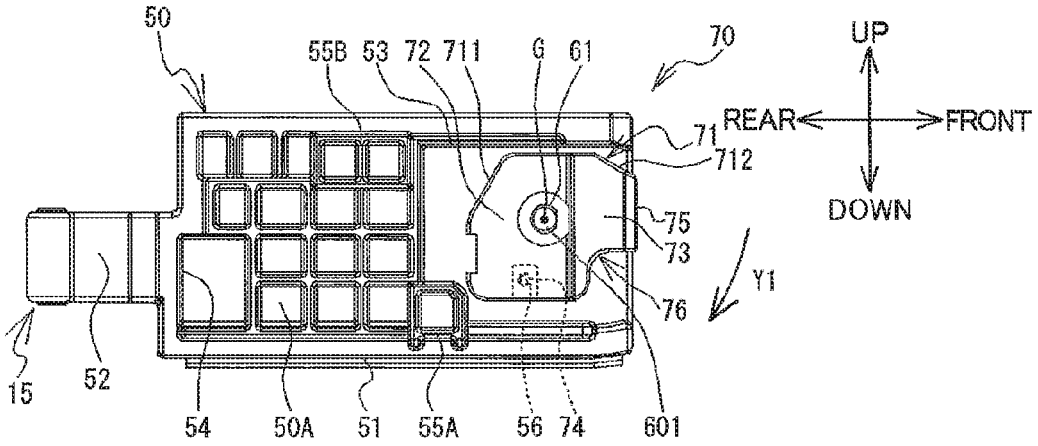
FIG. 9 is a left side view of a battery cover and a holding portion when a first rotating member is positioned at a battery lock position, according to a first modification.
Figure 10:
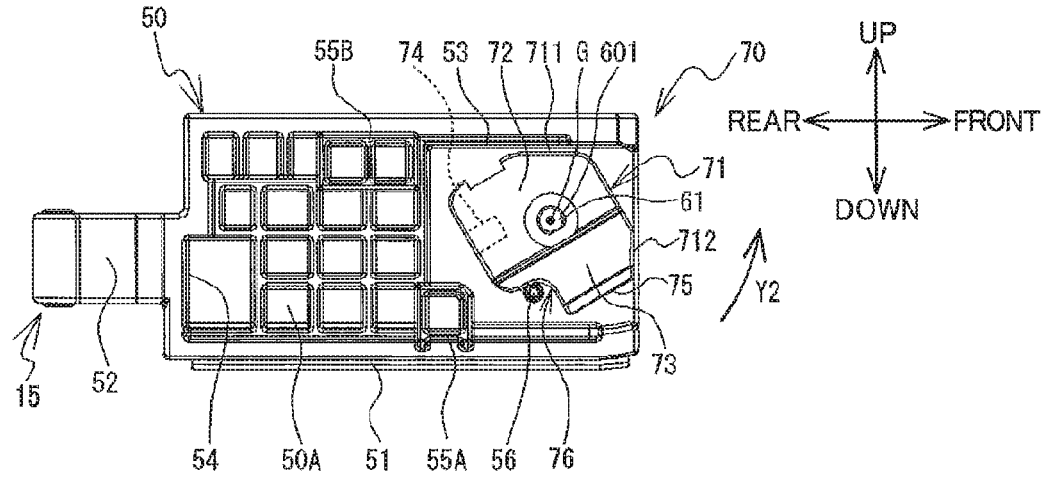
FIG. 10 is the left side view of the battery cover and the holding portion when the first rotating member is positioned at a battery unlock position, according to the first modification.

The present disclosure is not limited to the above-described embodiment but may be variously modified. With reference to FIGS. 9 and 10, a first modification will be described. The same reference numerals are given to the same components having the same functions as those in the above-described embodiment, and descriptions thereof will be omitted. The first modification differs from the above embodiment in that it has a shaft part 601 in place of the shaft part 60. The shaft part 601 differs from the shaft part 60 in the position at which it penetrates the first rotating member 71. That is, the shaft part 60 penetrates the first rotating member 71 above the gravity center G of the entire holding portion 70; while the shaft part 601 penetrates the first rotating member 71 at a position passing the gravity center G of the entire holding portion 70.

With this configuration, the first rotating member 71 is rotated about the shaft part 601 between the cover lock position (see FIG. 9) and the cover unlock position (see FIG. 10). When rotated in the arrow Y1 direction, the first rotating member 71 is moved from the cover lock position to the cover unlock position, and when rotated in the arrow Y2 direction, the first rotating member 71 is moved from the cover unlock position to the cover lock position.

The shaft part 601 about which the first rotating member 71 is rotated passes the gravity center G of the entire holding portion 70. Thus, even if an impact is applied to the printer 1 in any radial direction of the shaft part 60, force is distributed equally onto one side of the holding portion 70 with respect to the shaft part 601 in the direction perpendicular to the impact applied direction and the other side thereof. This prevents the first rotating member 71 from being rotated from the cover lock position to the cover unlock position, which in turn prevents the battery cover 50 from being turned from the closing position to the opening position. Thus, in the printer 1 according to the first modification, the battery 10 can be prevented from coming off from the battery housing part 20 due to an impact applied to the printer 1.

The printer 1 according to the first modification described above that has the shaft part 601 need not have the restricting portion 74 and the projection 56 and, further, need not have the second rotating member 79. For example, the shaft part 601 may be fixed to the battery cover 50. In this case, the first rotating member 71 may be rotatably supported by the shaft part 601.

Figure 11:
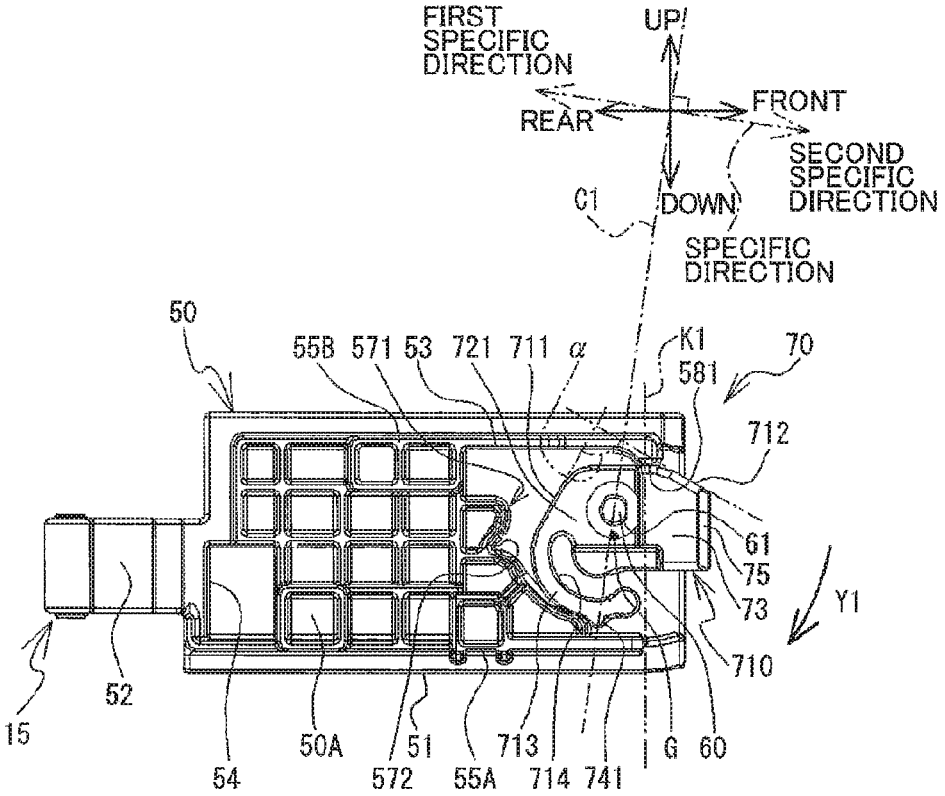
FIG. 11 is a left side view of a battery cover and a holding portion when a first rotating member is positioned at a battery lock position, according to a second modification.
Figure 12:
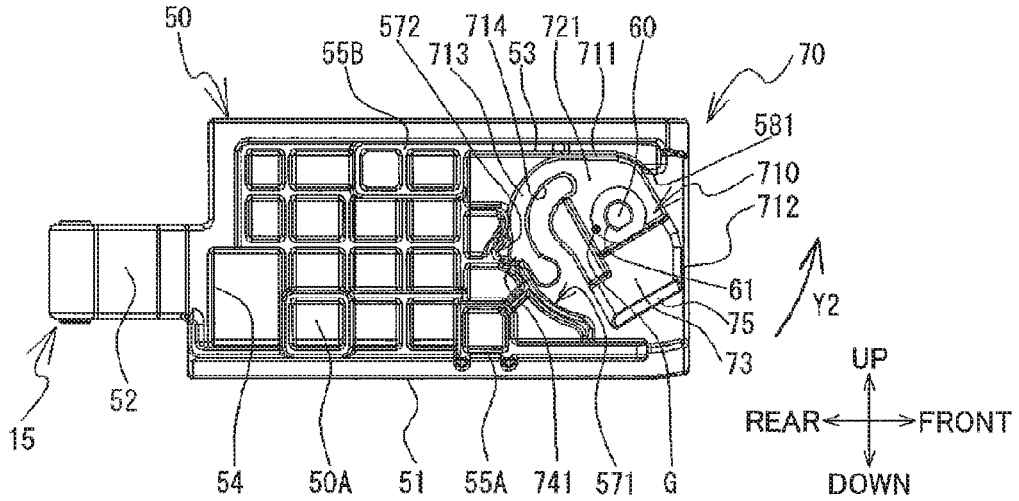
FIG. 12 is the left side view of the battery cover and the holding portion when the first rotating member is positioned at a battery unlock position, according to the second modification.

With reference to FIGS. 11 and 12, a second modification will be described. The second modification differs from the above embodiment in that it has a first rotating member 710 in place of the first rotating member 71. Like the first rotating member 71, the first rotating member 710 can be rotated about the shaft part 60 between the cover lock position (see FIG. 11) and the cover unlock position (see FIG. 12). Hereinafter, a description will be given assuming that the first rotating member 710 is at the cover lock position (see FIG. 11).

As illustrated in FIG. 11, the first rotating member 710 is connected to a part of the shaft part 60 on the specific surface 50A side of the battery cover 50. More specifically, the first rotating member 710 is connected to substantially the center portion of the shaft part 60. The shaft part 60 penetrates the first rotating member 710 above the gravity center G of the entire holding portion 70 (first and second rotating members 710 and 79). The gravity center G of the entire holding portion 70 in the second modification is disposed at the center of the first rotating member 710 in a side view. The shaft part 60 is fixed to the first rotating member 710 by the C-ring 61.

The first rotating member 710 is a plate-like member having a polygonal shape in a side view. The first rotating member 710 includes a side 711, a side 712, and a curved part 713. The side 711 defines the upper-rear side edge of the first rotating member 710 and extends obliquely upward with respect to the front side. The side 712 defines the upper-front side edge of the first rotating member 710 and extends obliquely downward with respect to the front side. An angle $\alpha$ formed by the sides 711 and 712 is substantially 90°. When the first rotating member 710 is at the cover unlock position, the side 711 of the first rotating member 710 contacts the rotation restricting rib 53 (see FIG. 12).

The first rotating member 710 has a first part 721 and a second part 73. The first part 721 is disposed rearward of the virtual plane K1. The first part 721 includes a portion where the shaft part 60 penetrates the first rotating member 710. The C-ring 61 is provided leftward of the first part 721.

The first part 721 has the curved part 713 and a restricting portion 741. The curved part 713 extends downwardly to substantially the lower front side in a curved shape from the rear end portion to near the virtual plane K1 so as to draw a circular arc about the shaft part 60. As a result, in the first part 721, a curved recessed part 714 is formed on the shaft part 60 side relative to the curved part 713. The curved recessed part 714 extends from the upper side of the curved part 713 to near a connection portion between the side 711 and the curved part 713. The curved recessed part 714 extends in a curved shape so as to draw a circular arc about the shaft part 60.

The restricting portion 741 is provided at the lower-rear portion of the first part 721. The restricting portion 741 protrudes outward from the surface of the curved part 713 on the side opposite the shaft part 60. In the second modification, the restricting portion 741 is provided on the side opposite the shaft part 60 with respect to the gravity center G of the entire holding portion 70 in the direction perpendicular to the specific direction. That is, the distance between the shaft part 60 and restricting portion 741 is larger than the distance between the shaft part 60 and gravity center G of the entire holding portion 70.

The second part 73 is disposed on the second specific direction side relative to the first part 721. That is, the second part 73 is disposed frontward of the virtual plane K1.

In the second modification, the battery cover 50 is provided with a guide rib 571. The guide rib 571 protrudes leftward (to the paper surface front side in FIG. 11) from the specific surface 50A. The guide rib 571 extends in a curved shape along the curved part 713 on the opposite side of the shaft part 60 with respect to the curved part 713 so as to draw a circular arc about the shaft part 60. The guide rib 571 includes a recessed part 572. The recessed part 572 is recessed rearward from near the upper end portion of the guide rib 571. In the second modification, an abutting rib 581 that protrudes downward from the front end portion of the rotation restricting rib 53 is provided.

In the second modification having the above configuration, the movement of the first rotating member 710 when it is rotated between the cover lock position (see FIG. 11) and the cover unlock position (see FIG. 12) will be briefly described. As illustrated in FIG. 11, when the first rotating member 710 is at the cover lock position, the front end portion of the curved part 713 contacts the restricting portion 741 from the rear side. This restricts the first rotating member 710 from being rotated in the arrow Y1 direction from the cover lock position. Further, when the first rotating member 710 is at the cover lock position, the abutting rib 581 contacts the upper end portion of the first rotating member 710 from above. This restricts the first rotating member 710 from being rotated in the arrow Y2 direction from the cover lock position. As a result, a state where the holding portion 70 holds the battery cover 50 at the closing position is maintained.

When the first rotating member 710 is rotated in the arrow Y1 direction from the cover lock position, the curved part 713 is bent or deflected to the curved recessed part 714 side, allowing the restricting portion 741 to be slid on the guide rib 571 (the surface of the guide rib 571 that faces the shaft part 60). Thus, the first rotating member 710 can be stably rotated from the cover lock position to the cover unlock position. As illustrated in FIG. 12, when the first rotating member 710 is rotated up to the cover unlock position, the restricting portion 741 is fitted in the recessed part 572. This restricts the first rotating member 710 from being rotated from the cover unlock position. A case where the first rotating member 710 is rotated from the cover unlock position to cover lock position differs only in the rotation direction (the opposite direction with respect to the case where the first rotating member 710 is rotated from the cover lock position to the cover unlock position), so descriptions thereof will be omitted.

According to the above second modification, even if the first rotating member 710 is displaced with respect to the battery cover 50 in the left-right direction (the direction perpendicular to the paper surface of each of FIGS. 11 and 12) during a rotation from the cover lock position to the cover unlock position, there is little influence on engagement between the restricting portion 741 and the guide rib 571 (recessed part 572 or front end portion of the guide rib 571). Thus, in the printer 1 according to the second modification, an operation load when the user rotates the second rotating member 79 can be maintained constant.

In the above second modification, when the first rotating member 710 is rotated between the cover lock position to the cover unlock position, the curved part 713 is easily deflected to the curved recessed part 714 side. Thus, in the printer 1 according to the second embodiment, component tolerance ranges of the respective restricting portion 741 and guide rib 571 are alleviated.

In the above embodiment, the restricting portion 74 serves as the recessed part, and the projection 56 projects from the specific surface 50A. Alternatively, a configuration may be possible, in which the restricting portion 74 is formed into a projection, and a recessed part is formed in the specific surface 50A in place of the projection 56. The restricting portion 74 may be an end portion of the first part 72. That is, a configuration may be adopted, in which the projection 56 contacts the end portion (restricting part) of the first part 72 in the first rotating member 71 positioned at the third position from the direction (arrow Y1 direction, in the above embodiment) in which the first rotating member 71 is rotated from the cover lock position to the cover unlock position.

In the above embodiment, the inner lock member 80 is moved between the battery lock position and the battery unlock position in the front-rear direction. However, the inner lock member 80 may be moved in the up-down direction. In this case, for example, the inner lock member 80 may be provided near the upper edge or lower edge of the opening edge of the battery housing part 20. The inner lock member 80 may be configured to be rotated between the battery lock position and the battery unlock position. For example, this configuration can be realized by providing a shaft part extending in the left-right direction to the inner lock member 80. In this case, in place of the compression coil spring, a torsion spring may be adopted as the urging member 81. Further, both the inner lock member 80 and the urging member 81 may be omitted.

In the above embodiment, the printer 1 has the plurality of protruding ribs 55A and 55B. However, the printer 1 need not have the protruding ribs 55A and 55B, or may have only one of the protruding ribs 55A and 55B. Further, the number of protruding ribs may be three or more. The plurality of protruding ribs 55A and 55B contact the battery 10 housed in the battery housing part 20 when the battery cover 50 is at the closing position; however, the plurality of protruding ribs 55A and 55B may not contact the battery 10.

In the above embodiment, the hinge 15 extends in the up-down direction. Alternatively, the hinge 15 may extend in, e.g., the left-right direction. In this case, the hinge extending in the left-right direction may be provided on the upper side or the lower side of the battery housing part 20. Further, the battery cover 50 is rotatably supported by the hinge 15 in the above embodiment; however, it may be detachably attached to the main body casing 2. That is, a state where the battery cover 50 is attached to the main body casing 2 corresponds to the closing position of the battery cover 50, and a state where the battery cover 50 is detached from the main body casing 2 corresponds to the opening position of the battery cover 50.

In the above embodiment, when the first rotating member 71 is at the cover lock position, the engagement protruding part 75 protrudes frontward from the front edge of the batter cover 50; however, the engagement protruding part 75 may protrude from any one of the edges of the battery cover 50. In this case, the engagement recessed part 40 may be provided at a portion with which the engagement protruding part 75 can be engaged.

In the above embodiment, when the first rotating member 71 is at the cover lock position, a part (engagement protruding part 75) of the second part 73 of the first rotating member 71 protrudes frontward from the front edge of the battery cover 50. Alternatively, when the first rotating member 71 is at the cover lock position, the entire second part 73 of the first rotating member 71 may protrude frontward from the front edge of the battery cover 50 as the engagement protruding part 75.

While the description has been made in detail with reference to specific embodiment(s) thereof, it would be apparent to those skilled in the art that various changes and modifications may be made therein without departing from the spirit and scope of the above described embodiment(s).

What is claimed is:

1. A printing apparatus comprising:

a printing part configured to perform printing;

an accommodating portion having a recessed part configured to accommodate a battery configured to supply power to the printing part;

a cover movable between a first position to close the accommodating portion and a second position to open the accommodating portion, the cover having a specific surface configured to face the accommodating portion and an edge portion which is a contour of the cover;

a shaft portion extending in a first direction perpendicular to the specific surface;

a holding portion configured to hold the cover at the first position; and an engaging portion configured to engage with the holding portion;

the holding portion comprising:

a first rotating member having an engaged part, the first rotating member being connected to the shaft portion and configured to rotate between a third position and a fourth position about the shaft portion, the engaged part protruding outside the edge portion so that the engaged part engages with the engaging portion when the first rotating member is positioned at the third position, the first rotating member in its entirety being positioned inside the edge portion so that the first rotating member is separated from the engaging portion when the first rotating member is positioned at the fourth position, the first rotating member comprising:

a first part including a restricting portion configured to restrict the rotation of the first rotating member from the third position to the fourth position, the shaft portion and the restricting portion defining an imaginary plane passing through the shaft portion and the restricting portion, the imaginary plane defining a first specific direction and a second specific direction each being perpendicular to the imaginary plane, the first specific direction being opposite to the second specific direction; and a second part positioned downstream of the first part in the second specific direction, the second part having a thickness in the first direction greater than that of the first part; and a second rotating member connected to the shaft portion and positioned downstream of the shaft portion in the first specific direction, the second rotating member being configured to rotate about the shaft portion together with the first rotating member.

2. The printing apparatus according to claim 1, wherein, when the first rotating member is positioned at the third position, at least part of the second part protrudes outside the edge portion to engage with the engaging portion.

3. The printing apparatus according to claim 1, wherein the shaft portion penetrates the cover in the first direction and is rotatably supported by the cover, the shaft portion having a first connecting portion and a second connecting portion opposite to the first connecting portion, the first connecting portion being closer to the specific surface than the second connecting portion is to the specific surface;

wherein the first rotating member is connected to the first connecting portion; and wherein the second rotating member is connected to the second connecting portion.

4. The printing apparatus according to claim 1, further comprising a projection protruding from the specific surface; and wherein the restricting portion has a recessed portion, the projection configured to be fitted in the recessed portion when the first rotating member is positioned at the third position.

5. The printing apparatus according to claim 1, wherein the accommodating portion has an opening formed with an opening edge portion; and the printing apparatus further comprises:

a moving member movable between a fifth position and a sixth position, the moving member having a part protruding inside the opening edge portion when the moving member is positioned at the fifth position, and the moving member in its entirety being outside the opening edge portion when the moving member is positioned at the sixth position; and an urging member urging the moving member in a second direction toward the fifth position from the sixth position.

6. The printing apparatus according to claim 5, further comprising a contacting portion protruding from the specific surface, the contacting portion configured to contact with, in a third direction opposite to the second direction, the moving member at the fifth position when the cover is positioned at the first position.

7. The printing apparatus according to claim 6, further comprising a hinge configured to rotatably support the cover; and wherein the moving member at the sixth position is positioned between the accommodating portion and the hinge in the second direction and the third direction.

8. The printing apparatus according to claim 1, further comprising a protruding portion protruding from the specific surface.

9. A printing apparatus comprising:

a printing part configured to perform printing;

an accommodating portion having a recessed part configured to accommodate a battery configured to supply power to the printing part;

a cover movable between a first position to close the accommodating portion and a second position to open the accommodating portion, the cover having a specific surface configured to face the accommodating portion and an edge portion which is a contour of the cover;

a shaft portion extending in a first direction perpendicular to the specific surface;

a holding portion configured to hold the cover at the first position; and an engaging portion configured to engage with the holding portion;

the holding portion comprising:

a first rotating member having an engaged part, the first rotating member being connected to the shaft portion and configured to rotate between a third position and a fourth position about the shaft portion, the engaged part protruding outside the edge portion so that the engaged part engages with the engaging portion when the first rotating member is positioned at the third position, the first rotating member in its entirety being positioned inside the edge portion so that the first rotating member is separated from the engaging portion when the first rotating member is positioned at the fourth position, the first rotating member comprising:

a first part including a restricting portion configured to restrict the rotation of the first rotating member from the third position to the fourth position, the shaft portion and the restricting portion defining an imaginary plane passing through the shaft portion and the restricting portion, the imaginary plane defining a first specific direction and a second specific direction each being perpendicular to the imaginary plane, the first specific direction being opposite to the second specific direction, the imaginary plane dividing the holding portion into a first holding portion and a second holding part, the first holding part defining a moment acting thereon that is balanced with that of the second holding part; and a second part positioned downstream of the first part in the second specific direction; and a second rotating member connected to the shaft portion and positioned downstream of the shaft portion in the first specific direction, the second rotating member being configured to rotate about the shaft portion together with the first rotating member.

10. The printing apparatus according to claim 9, wherein, when the first rotating member is positioned at the third position, at least part of the second part protrudes outside the edge portion to engage with the engaging portion.

11. The printing apparatus according to claim 9, wherein the shaft portion penetrates the cover in the first direction and is rotatably supported by the cover, the shaft portion having a first connecting portion and a second connecting portion opposite to the first connecting portion, the first connecting portion being closer to the specific surface than the second connecting portion is to the specific surface;

wherein the first rotating member is connected to the first connecting portion; and wherein the second rotating member is connected to the second connecting portion.

12. The printing apparatus according to claim 9, further comprising a projection protruding from the specific surface; and wherein the restricting portion has a recessed portion, and the projection is configured to be fitted in the recessed portion when the first rotating member is positioned at the third position.

13. The printing apparatus according to claim 9, wherein the accommodating portion has an opening formed with an opening edge portion; and the printing apparatus further comprising:

a moving member movable between a fifth position and a sixth position, the moving member having a part protruding inside the opening edge portion when the moving member is positioned at the fifth position, the moving member in its entirety being outside the opening edge portion when the moving member is positioned at the sixth position; and an urging member urging the moving member in a second direction toward the fifth position from the sixth position.

14. The printing apparatus according to claim 13, further comprising a contacting portion protruding from the specific surface, the contacting portion configured to contact with, in a third direction opposite to the second direction, the moving member at the fifth position when the cover is positioned at the first position.

15. The printing apparatus according to claim 14, further comprising a hinge configured to rotatably support the cover; and wherein the moving member at the sixth position is positioned between the accommodating portion and the hinge in the second direction and the third direction.

16. The printing apparatus according to claim 9, further comprising a protruding portion protruding from the specific surface.

* * * * *